US005467878A

United States Patent [19]

Derksen

[11] Patent Number: 5,467,878

[45] Date of Patent: Nov. 21, 1995

[54] CLOSURE FOR AN INJECTION BOTTLE

[75] Inventor: Klaus Derksen, Karlsbad-Ittersbach, Germany

[73] Assignee: Firma Carl Freudenberg, Weinheim, Germany

[21] Appl. No.: 153,727

[22] Filed: Nov. 17, 1993

[30] Foreign Application Priority Data

Nov. 17, 1992 [DE] Germany ..... 42 38 682.9

[51] Int. Cl.[6] ..... B65D 39/00

[52] U.S. Cl. ..... 215/253; 215/247; 215/249; 604/411

[58] Field of Search ..... 215/247, 249, 215/251, 253, 296, 297, 305, 351, 352, 355; 383/96; 220/270, 272, 273; 604/411, 415

[56] References Cited

U.S. PATENT DOCUMENTS

| | | | |
|---|---|---|---|
| 2,066,390 | 1/1937 | Cahoon et al. | 215/253 |
| 3,292,807 | 12/1966 | Golde | 215/305 |
| 3,905,368 | 9/1975 | Lewis, Jr. et al. | 215/249 |
| 3,970,207 | 7/1976 | Faulstich | 215/296 |
| 4,412,623 | 11/1983 | Schmidt | 215/247 |
| 4,434,904 | 3/1984 | D'Amico et al. | 215/253 |
| 4,822,351 | 4/1989 | Purcell | 604/411 |
| 4,995,521 | 2/1991 | Von Schuckmann | 215/249 |
| 5,031,675 | 7/1991 | Lindgren | 604/411 |
| 5,041,106 | 8/1991 | Noji et al. | 604/411 |

FOREIGN PATENT DOCUMENTS

4103041A1 4/1992 Germany .

*Primary Examiner*—David T. Fidei
*Attorney, Agent, or Firm*—Kenyon & Kenyon

[57] ABSTRACT

A closure for an injection bottle is disclosed which has an insert part for covering the mouth of the bottle, a cylindrical section having an inside diameter which is substantially identical to its length, the cylindrical section having a sealing lip on an inner circumferential surface for allowing sealed insertion of a syringe, and an intermediate ring connecting the cylindrical section to the insert part, the intermediate ring having an essentially Z-shaped cross section.

5 Claims, 2 Drawing Sheets

CLOSURE FOR AN INJECTION BOTTLE

FIELD OF THE INVENTION

The present invention relates generally to injection bottles, and more particularly to a closure for an injection bottle which allows for sealed insertion of a syringe.

BACKGROUND OF THE INVENTION

An injection bottle is shown in German application DE-OS 41 03 041. A closure cap and the injection bottle consist of plastic, the closure cap having a double-walled cover region with the outer wall as a tear-off part and the inner wall as a syringe-insert part. The syringe-insert part has an essentially circular opening with an elastic lip which surrounds a syringe of larger diameter and seals it over its circumference. The injection bottle can be manufactured in a favorable manner from the standpoint of manufacturing technology and economy since all parts which are used consist of plastic and are capable of reuse. In connection with this however it must be noted that the lip contacts the syringe in a substantially linear application which can lead to sealing edge damage upon introduction of the syringe into the injection bottle. During the intended use, leakages may then develop. Furthermore, the syringes which remove the contents of the injection bottle must always have essentially the same outside diameter since only very slight diameter tolerances of the syringes can be compensated for without causing an impairment of the seal.

OBJECTS AND SUMMARY OF THE INVENTION

An object of the present invention is to provide an injection bottle in such a manner that the sealing lip assures an improved seal over the outer circumference of the syringe even when using syringes with different outside diameters.

Another object of the invention is to provide essentially the same radial contact pressure on the syringe over its outer circumference even with different diameter syringes.

The present invention therefore provides a closure for an injection bottle comprising an insert part for covering the mouth of the bottle; a cylindrical section having an inside diameter which is substantially identical to its length, the cylindrical section having a sealing lip on an inner circumferential surface for allowing sealed insertion of a syringe; and an intermediate ring connecting the cylindrical section to the insert part, the intermediate ring having an essentially Z-shaped cross section.

The insert part of the injection bottle is provided with the cylindrical section having a sealing lip on its radially inward facing side, the cylindrical section having an inside diameter which is substantially identical to its length and the cylindrical section being connected to the insert part by an intermediate ring which has an essentially Z-shaped profile, with the cylindrical section and intermediate ring together forming a U-shaped profile.

An advantage of this arrangement is that the contents of the injection bottle can be removed by syringes of different outside diameters without damaging the seal around the outer circumference of the syringes. Assuming an average outside diameter of the syringe, diameter deviations of ±25% can be compensated for without any leakage occurring in the region of the sealing surface between the sealing lip and the syringe. Due to the Z-shaped intermediate ring, the sealing lip yields elastically in a radial direction, the radial contact pressure of the sealing lip on the outer circumference of the syringe to be sealed off always being substantially the same within the tolerance range.

Still a further advantage is that the danger of any damage to the sealing lip upon the introduction of the syringe is minimized by the cylindrical nature of the sealing lip, thereby allowing particularly simple handling and good sealing properties during use.

With a view towards simple manufacture of the insert part and low costs of manufacture resulting therefrom, the cylindrical section and the intermediate ring can have a substantially identical wall thickness. Particularly in the region of the transitions between the sealing lip, which is formed by the cylindrical section, and the intermediate ring, substantially identical wall thicknesses result in manufacture without different shrinkage stresses within the insert part. The material stress is thus distributed uniformly within the insert part.

In the region of its axially opposite ends the intermediate ring can be connected to the cylindrical section and to the insert part. The syringe can be introduced into the injection bottle in particularly simple manner if the cylindrical section tapers conically in the direction towards the injection bottle. Upon the introduction of the syringe into the injection bottle, this arrangement provides an initial centering to prevent damage in the region of the sealing lip, which is important for sealing.

In order to increase the radial application of the sealing lip on the side facing the injection bottle, the cylindrical section is preferably connected on this side to the intermediate ring, the intermediate ring being connected on its side facing away from the injection bottle to the insert part, they passing continuously into each other.

A good sealing of the syringe and a sufficiently large elastic resilience in the radial direction, together with a reliable positioning of the sealing lip within the insert part, may be achieved if the profile of the intermediate ring extends at its ends essentially perpendicular to the imaginary axis of the cylindrical section. Radial displacements of the syringe and thus of the sealing lip are taken up by the intermediate ring in the region of the ends. In view of the substantially identical wall thicknesses of the cylindrical section, intermediate ring and outer circumference of the insert part, no impairments of the properties during use need be feared, even in the event of a large number of load changes resulting from radial and axial displacements of the syringe within the insert part.

The profile of the intermediate ring between the ends preferably extends essentially parallel to the axis of the cylindrical section. It is advantageous that the intermediate ring is developed as a stop buffer and limits extreme deflections of the cylindrical section and the syringe in the radial direction. Due to this arrangement, twisting of the syringe in the region of the cylindrical section passage and the injection bottle is minimized so that the syringe is held reliably due to contact in the region of the sealing lip, even in an injection bottle which is upside down.

In accordance with another advantageous development, the cylindrical section can be arranged eccentrically within the insert part. It is advantageous in this connection that the cylindrical section is arranged staggered with respect to the seam of the injection bottle so that the bottom of the injection bottle can be more easily punctured.

The insert part can for instance have three cylindrical sections uniformly distributed in circumferential direction. It is advantageous in this respect that, for instance, several syringes can be introduced into the injection bottle. If for instance only one syringe is to be introduced, at least one cylindrical section lies outside the seam of the injection bottle and can therefore be inserted with less force.

BRIEF DESCRIPTION OF THE DRAWINGS

The injection bottle of the invention will be described further below in accordance with the following drawings.

DETAILED DESCRIPTION

Figure 1:
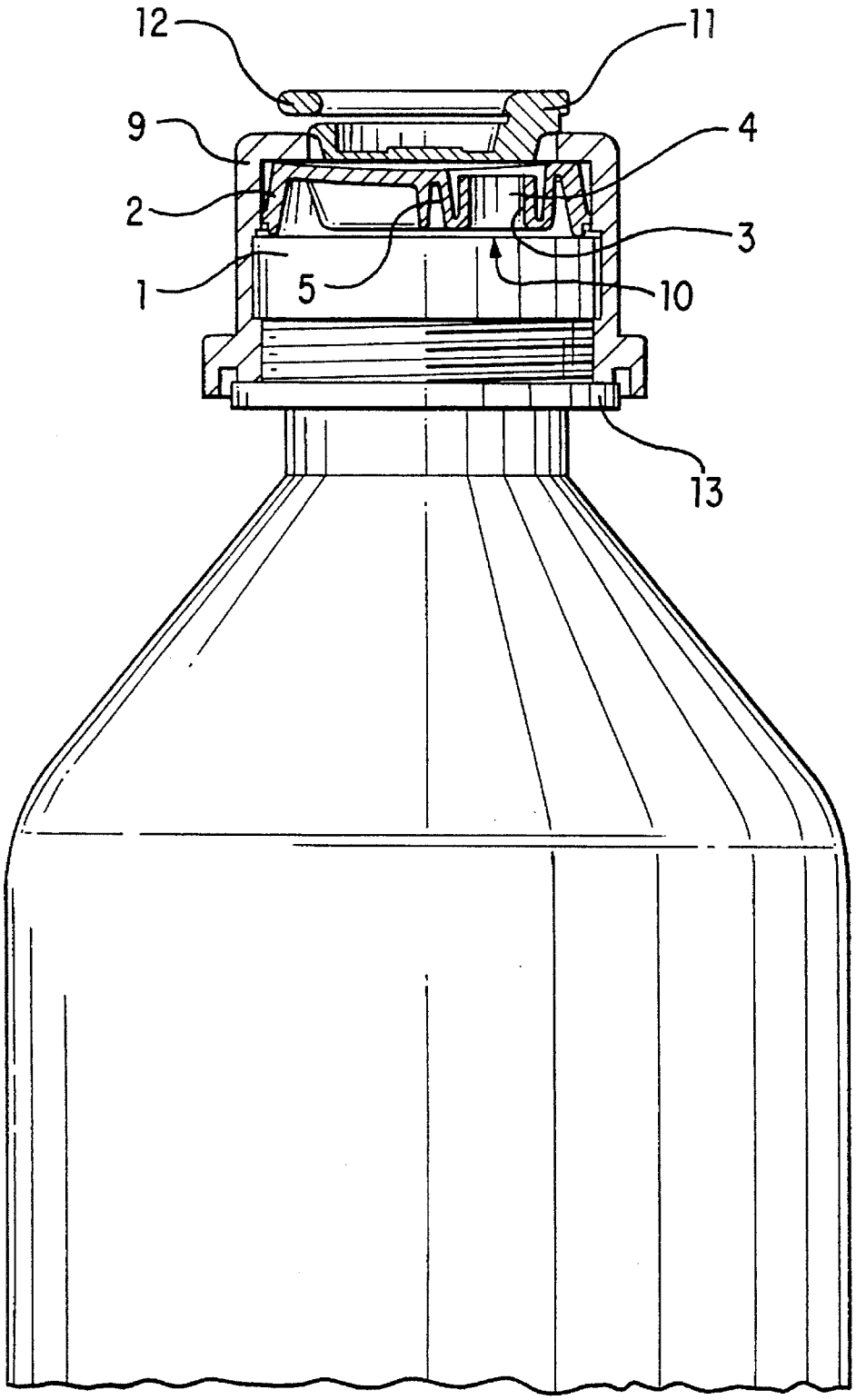
FIG. 1 shows the injection bottle of the invention with the closure cap having an insert part placed thereon.

FIG. 1 shows an embodiment, of the injection bottle according to the invention which is covered in the region of a mouth 1 by a closure cap 9. To ensure germ-free sealing of the injection bottle in the region of a rim 10, the closure cap is double-walled and has on its side facing away from the injection bottle a tear-off part 11 which can be removed from the closure cap 9 by a tear-off strap 12. On the side of the closure cap facing the injection bottle there is arranged a substantially disk-shaped insert part 2 which is fixed in liquid-tight manner in the closure cap 9. The closure cap 9 and the injection bottle are made of plastic and they are connected in liquid-tight manner in the region of a collar 13 which is formed integrally on the bottle neck of the injection bottle. The liquid-tight connection in the region of the collar 13 can for instance be produced by welding or gluing. The injection bottle, the closure cap 9 with the tear-off part 11 and the insert part 2 are preferably produced as injection-molded parts. The tear-off part 11 is delineated by a weakened line of relatively reduced thickness of material.

The content of the injection bottle can be removed by a syringe by first removing the tear-off part 11 from the closure cap 9 and then inserting the syringe through the sealing lip 3 of the insert part 2 and subsequently through the rim 10 of the injection bottle into the hollow space of the latter. The entire injection bottle is made uniformly of thermoplastic, the insert part 2 being provided with a sealing lip 3 which can be widened by the syringe. The sealing lip 3 is formed by a cylindrical section 4 on the inner circumference of the cylindrical section 4 which faces an inserted syringe. The sealing lip 3 in sealing manner surrounds the inserted syringe over the syringe outer circumference with an initial radial tension. The cylindrical section 4 and the insert part 2 are connected by an intermediate ring 5, which as explained later is essentially Z-shaped. The cylindrical section 4 can have a slightly hollow conical profile in order to simplify removal from a mold.

Figure 2:
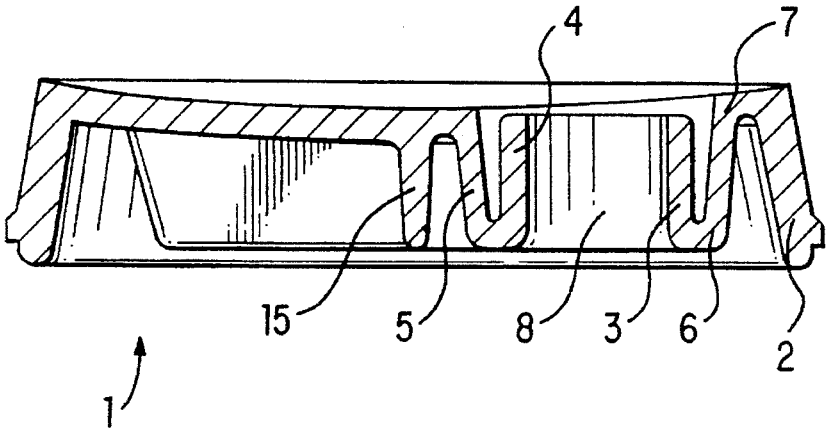
FIG. 2 shows a sectional view of the insert part of FIG. 1

The insert part 2 is shown as an individual part in FIG. 2. The cylindrical section 4 is formed along its axial extent with a conical taper in the direction towards the injection bottle. In this way, a centering effect results upon introduction of the syringe, and the sealing surface facing the syringe is protected against damage.

The essentially Z-shaped intermediate ring has an end 6 facing the injection bottle and an end 7 facing away from the injection bottle, and a main part extending between the two ends. Since the cylindrical section 4 is connected to intermediate ring 5 through its end 6, and since the intermediate ring 5 is connected to the insert part 2 through its end 7, an elastic resilience of the cylindrical section 4 results in the radial direction, which compensates for diameter tolerances of the syringe. The ends 6, 7 extend substantially perpendicular to an imaginary axis 8 of the cylindrical section 4 and the main part of the intermediate ring 5 between the ends 6, 7 extends substantially parallel to the axis 8. The end 6 therefore forms the bottom of the "Z" shape and the end 7 the top of the "Z" shape.

Syringes which have a diameter between 3 and 5 mm, for instance, may be used. Due to the arrangement of the insert part 2 and the resilience in radial direction, an approximately uniform application of the cylindrical section 4 in the radial direction against the syringe is assured within this diameter range and a reliable sealing results. The cylindrical section 4 is arranged eccentrically in the insert part 2 in such a manner that the manufacture-induced seam of the injection bottle in the region of its rim 10 need not be punctured by the syringe to be introduced.

Figure 3:
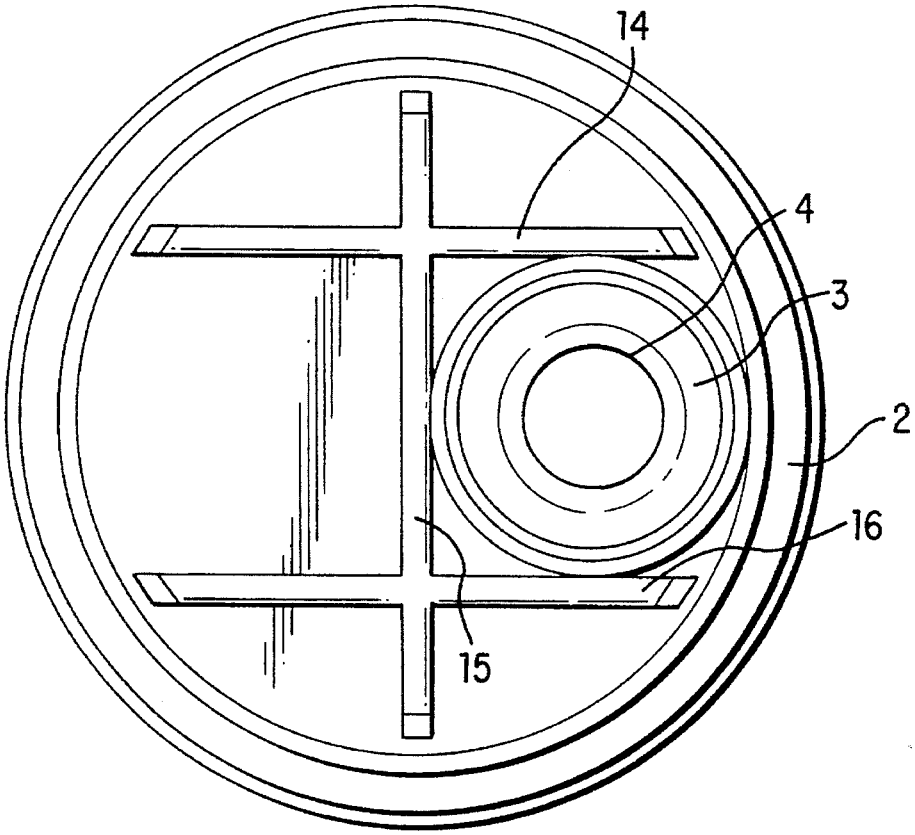
FIG. 3 is a bottom view of the insert part shown in FIG. 2.

FIG. 3 shows the insert part of FIG. 2 in elevation on the side facing the injection bottle. In order to prevent extensive bending of the insert part 2 upon the introduction of the syringe and thereby to assure a better transmission of force, the insert part 2 is provided with stiffening ribs 14, 15, 16 which at least partially surround the sealing lip 3 on the outside. The handling of the injection bottle is thus simplified.

What is claimed is:

1. A closure for an injection bottle comprising:

an insert part for covering the mouth of a bottle and having at least one hole for permitting insertion of a syringe;

a cylindrical section having an inside diameter and an inner circumferential surface for allowing sealed insertion of the syringe, and having a top section end and a bottom section end;

an intermediate ring having a top ring end, a bottom ring end and a main part extending between the top ring end and bottom ring end, the top ring end connected to the insert part at the hole and the bottom ring end connected to the bottom section end; the main part of the intermediate ring spaced apart from the cylindrical section; and a closure cap for sealing the bottle in a liquid-type manner and for attaching the insert part to the injection bottle, the closure cap having a tear off-part for permitting access to the insert part.

2. The closure as recited in claim 1 wherein the cylindrical section, the intermediate ring and the insert part are integral.

3. The closure as recited in claim 1 wherein the cylindrical section has a lengthwise axis and the main part of the intermediate ring is substantially parallel to the axis.

4. The closure as recited in claim 1 wherein the cylindrical section has a lengthwise axis and the bottom ring end and top ring end are substantially perpendicular to the axis.

5. The closure as recited in claim 1 wherein the cylindrical section and the intermediate ring have substantially identical wall thicknesses.

* * * * *